US005873993A

United States Patent [19]

Stubergh

[11] Patent Number: 5,873,993

[45] Date of Patent: Feb. 23, 1999

[54] METHOD AND APPARATUS FOR THE PRODUCTION OF SILICIUM METAL, SILUMIN AND ALUMINIUM METAL

[76] Inventor: Jan Stubergh, Knuten 63, N-1507 Moss, Norway

[21] Appl. No.: 750,361

[22] PCT Filed: Jun. 2, 1995

[86] PCT No.: PCT/NO95/00092

§ 371 Date: Feb. 25, 1997

§ 102(e) Date: Feb. 25, 1997

[87] PCT Pub. No.: WO95/33870

PCT Pub. Date: Dec. 14, 1995

[30] Foreign Application Priority Data

Jun. 7, 1994 [NO] Norway ..... 942121

[51] Int. Cl.[6] ..... C25C 3/00; C25C 3/06; C25C 3/08; C25C 3/34

[52] U.S. Cl. ..... 205/364; 205/372; 205/410; 204/244; 204/245

[58] Field of Search ..... 204/243 R, 244, 204/245, 246, 247, 294; 205/364, 372, 410

[56] References Cited

U.S. PATENT DOCUMENTS

| | | | |
|---|---|---|---|
| 2,850,443 | 9/1958 | Allerton | 205/364 |
| 2,866,701 | 12/1958 | Strauss | 75/60 |
| 3,022,233 | 2/1962 | Olstowski | 204/60 |
| 3,405,043 | 10/1968 | Barakat et al. | 204/243 R X |
| 3,480,654 | 11/1969 | Sundermeyer et al. | 204/244 X |
| 3,980,537 | 9/1976 | McMinn et al. | 205/364 |
| 4,246,249 | 1/1981 | Dawless | 423/348 |
| 4,292,145 | 9/1981 | DeMattei et al. | 204/60 |

OTHER PUBLICATIONS

Stubergh, "*Fremstilling av silisium og alumnium i en kontineurlig prosess ved bruk av norsk feltspat som råstoff*", Oslo College of Engineering, Norway, ISBN 82–993110–0–4, pp. 1–31 (1993) (No Month).

*Primary Examiner*—Donald R. Valentine
*Attorney, Agent, or Firm*—Wenderoth, Lind & Ponack, L.L.P.

[57] ABSTRACT

The present invention concerns a procedure for continuous or batch production in one or possibly more steps in one or more furnaces of silicon metal (Si), possibly silumin (AlSi alloys) and/or aluminium metal (Al) in the required conditions in a melting bath, preferably using feldspar or feldspar containing rocks dissolved in a fluoride and process equipment for implementing the procedure. Highly pure silicon is produced by electrolysis (step I) in a first furnace comprising a replaceable carbon anode (3) located at the bottom of the furnace and a carbon cathode (1) located at the top of the furnace. For the production of silumin the Si-poor residual electrolyte from step I is transferred to a second furnace and aluminium metal is added (step II). Aluminium metal is produced in a third furnace (step III) by electrolysis after Si has been removed in step I and possibly in step II. The present invention also concerns the production of silicon, possibly silumin and/or aluminium by using process equipment comprising tow or more furnaces integrated to form one unit with (an) intermediate partition wall(s) which is/are designated to transfer the electrolyte from one furnace to another.

15 Claims, 5 Drawing Sheets

I

I

II

III $(Na,Ca)Al_bF_xO_y$

METHOD AND APPARATUS FOR THE PRODUCTION OF SILICIUM METAL, SILUMIN AND ALUMINIUM METAL

This application is a section 371 application of PCT/NO95/00092 filed Jun. 2, 1995.

BACKGROUND OF THE INVENTION

The present invention concerns a procedure for continuous and batch production in one or possibly more steps in one or more furnaces of silicon "metal" (Si), possibly silumin (AlSi alloys) and/or aluminium metal (Al) in the required ratio in a molten bath, preferably using feldspar or feldspar containing rocks dissolved in a fluoride, as well as process equipment for the implementation of the procedure.

Controlled production of high purity silicon by electrolysis using feldspar or species of rock containing feldspar dissolved in fluoride has been a problem up to now.

Continuous production of silicon and silumin has previously been described in ISBN 82-993110-0-4, which is the inventor's own publication. Minerals (species of rock) poor in iron such as feldspar ((Ca, Na, Ka)$Al_{2-1}Si_{2-3}O$), pegmatite, granite syenite or anorthosite can be used in a mixture with NaF or cryolite and electrolysed directly with an Al (Al—Si) cathode to produce pure Si (99%). The disadvantage of the method stated in relation to the present application is that electrolysis for the production of Si cannot take place in controlled fashion separately from aluminothermic reduction when Al is present. As the aluminothermic reduction is rapid, a lot of Al will be oxidised and used at the same time as current passes through the cell for the reduction of Si (IV). As a lot of Al is consumed, a lot of Al(III) must be recovered to form Al by electrolysis and, besides, a lot of silumin is formed. Today, this is not desirable because the Si market is much larger than the silumin market. Besides, electrolysis of Si on Al requires more energy with a Si-rich Al cathode surface because solid Si is formed at a process temperature of 1000° C. (melting point (Si)=1410° C.). Solid Si has semiconductor properties and, therefore, high electrical resistance. The Si particles which are formed are deposited mainly on the outside of the molten Al metal (in this case Si should be considered as the cathode instead of Al).

In ISBN 82-993110-0-4, it is further stated that Si crystals containing approximately 1% Al will crystallise on the Al cathode surface, in silumin and/or at the bottom. The Si crystals formed by electrolysis can be sucked, raked and/or filtered from the Al cathode. The disadvantage of so much (1%) Al being formed in the Si crystals is that it is difficult to remove this Al by known refinement methods. Since only small amounts of Si are observed formed on the surface and at the bottom, it is difficult to remove them with known technique.

The equipment in ISBN 82-993110-0-4, as sketched in FIG. 1, lacks detail and does not show how Si is separated from the silumin. Nor does it show how the electrolyte runs over into the bath in which the Al is produced. U.S. Pat. No. 3,022,233 describes the production of Si, a metal silicide, fluorocarbons and silicon tetrafluoride in one and the same step, but the quality of the Si and the temperature of the process are not stated. The starting materials are $SiO_2$ dissolved in alkaline or alkaline earth fluorides or fluorides of rare earth metals. The cathode is made of metal.

In U.S. Pat. No. 3,405,043, just silicon is produced and it is important that the raw material (silica) is pure. The silica raw material is dissolved in cryolite. During electrolysis Si sticks to the cathode like an adhesive ball; the cathode must be removed and cleaned periodically. The anode and the cathode are fastened vertically beside one another.

SUMMARY OF THE INVENTION

The present invention concerns a procedure for continuous and batch production in one or possibly more steps in one or more furnaces of silicon metal (Si), possibly silumin (AlSi alloys) and/or aluminium metal (Al) in the required conditions in a melting bath, preferably using feldspar or species of rock containing feldspar dissolved in a fluoride. The procedure is characterised in that highly pure silicon metal is produced by electrolysis in a first step (step I), in a bath in which a carbon cathode (1) is used, located at the top of the bath, and a carbon anode (3), located mainly at the bottom of the bath, whereby the Si metal is extracted by enrichment in the bath and/or precipitation (2) on the cathode; that silumin may be produced in a second step (step II) by Al metal being added to the residual electrolyte from the bath so that the remaining Si and Si(IV) are reduced and precipitated as silumin; and that aluminium metal is produced in a third step (step III) by electrolysis after the Si has been removed in step I and possibly in step II.

The present invention also concerns process equipment for continuous and batch production in one or possibly more steps in one or more furnaces of silicon metal (Si), possibly silumin (AlSi alloys), and/or aluminium metal (Al) in the required conditions in a molten bath, preferably using feldspar or feldspar containing rocks dissolved in fluoride. The process equipment is characterised in that it comprises at least two furnaces, a first furnace for the production of silicon metal (step I) comprising a container (8), an anode (3) consisting of at least one piece of carbon (8) arranged at the bottom of the container (8) and at least one cathode (1) of carbon which is arranged at the top of the container (8) (FIG. 1); and that silumin may be produced in a second step (step II) in a second furnace by Al metal being added to the residual electrolyte from the bath so that the remaining Si and Si(IV) are reduced and precipitated as silumin; and that aluminium metal is produced in a third step (step III) in a third furnace by electrolysis after Si has been removed in step I and possibly in step II.

DETAILED DESCRIPTION OF THE INVENTION

The silicon metal produced in step I can be extracted by Si enriched at the top of the bath being taken out, the cathode being removed from the bath and Si which is attached to it being removed, and Si in the bath and on the cathode being precipitated to the bottom by stopping the electrolysis, after which it is removed from the bottom.

Si-free residual electrolyte from step I can be electrolysed directly to produce aluminium metal (step III).

Step II may comprise addition of aluminium or aluminium scrap in a quantity such that silumin is produced with a preselected ratio between Si and Al from step I and an Al-rich, Si-poor electrolyte.

Al bound in silumin can be selectively dissolved by NaOH and solid Si can be separated. $CO_2$ gas can be added to the resulting Al-rich solution, the $CO_2$-gas being at least partly formed at the anode in step I, so that $Al(OH)_3$ is precipitated and the precipitated $Al(OH)_3$ is converted by a known method to $Al_2O_3$ and/or $AlF_3$.

The Al-rich, Si-poor electrolyte from step II can be electrolysed in step III, optionally after addition of $Al_2O_3$ and/or $AlF_3$ as indicated above.

Figure 5:
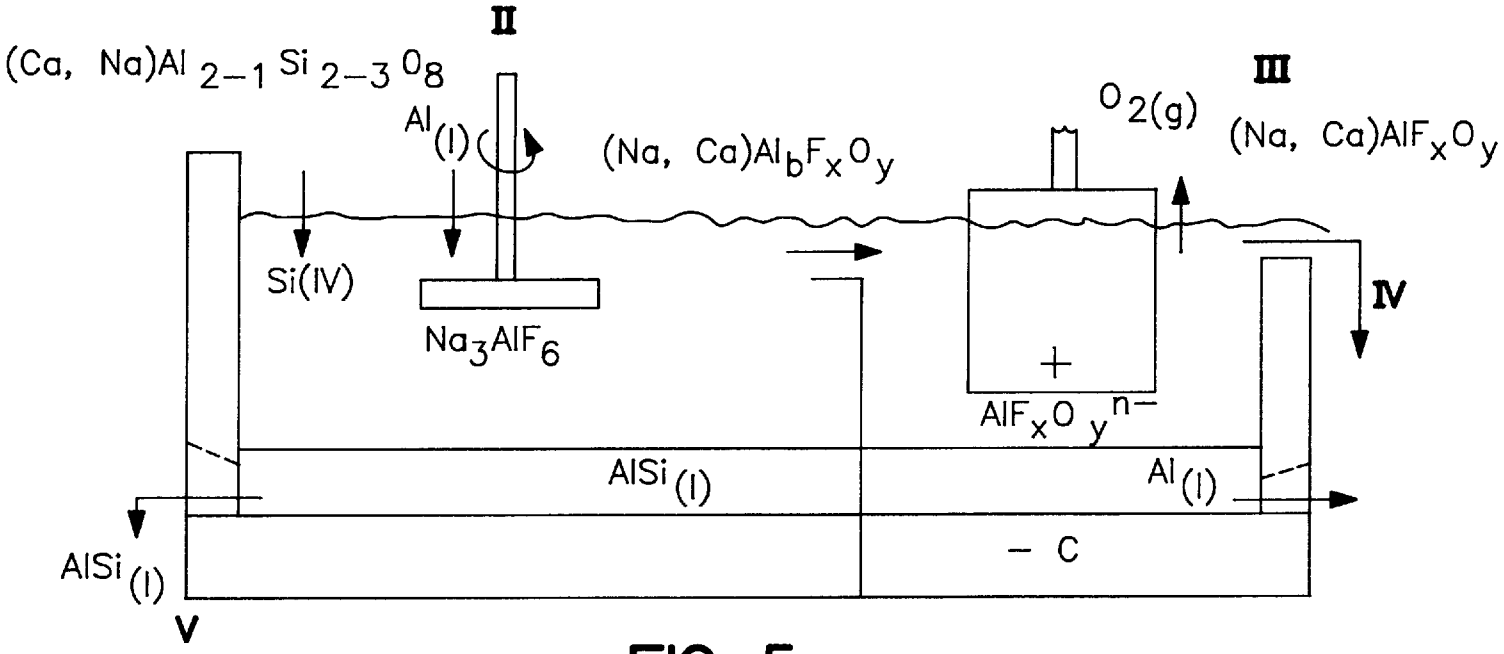

In the process equipment, the second and third furnaces can be integrated to form a unit with an intermediate partition wall so that the electrolyte from the second furnace can be designed to be transferred to the third furnace for the production of aluminium metal in the latter (FIG. 5).

The first and third furnaces can be integrated to form a unit with an intermediate partition wall, and the Si-free residual electrolyte from the first furnace can be designed to be transferred to the third furnace for the production of aluminium metal in the latter.

The furnaces can also be integrated to form a unit with intermediate partition walls.

The anode or anodes (3) is/are replaceable as the vertical piece of carbon which is fastened to the piece of carbon (anode) at the bottom of the container is/are designed in such a way that it/they can be removed from the container in order that a new piece of carbon can be fitted.

The present invention is explained in more detail in the following with reference to FIGS. 1–7 and steps I–V.

Figure 1:
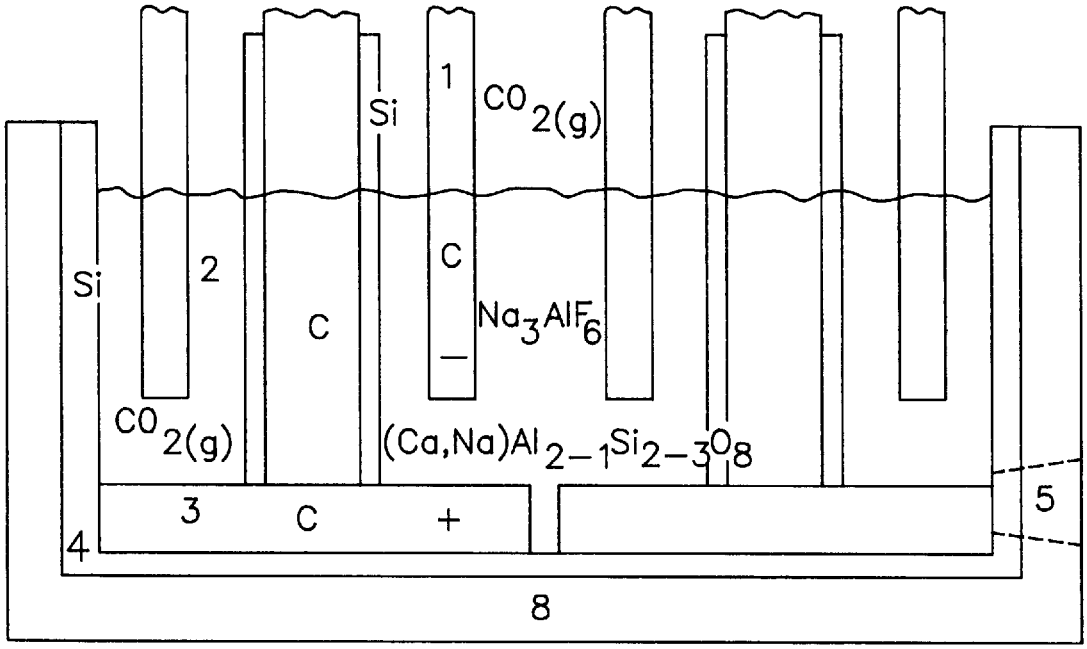
FIGS. 1–7 illustrate the production of Si, AlSi, and Al in accordance with the present invention.
Figure 2:
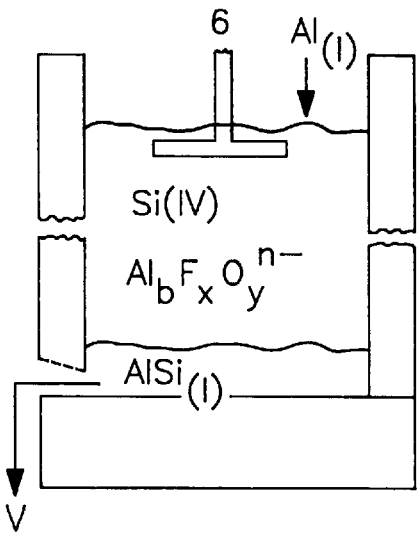
Figure 3:
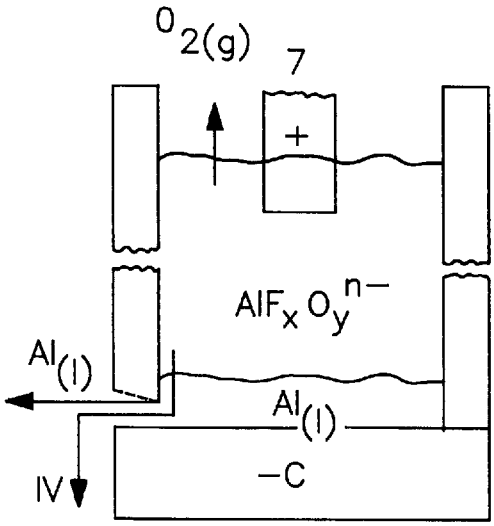

In FIGS. 1–3 the production of Si, AlSi and Al takes place in three different furnaces in steps I–III. FIG. 1 shows the electrolysis of Si with a carbon anode (+, at the bottom) and a carbon cathode (–, at the top) (step I). FIG. 2 shows a reduction bath with stirrer for the production of AlSi (step II). FIG. 3 shows the electrolysis of Al with an inert anode (+, at the top) and a carbon cathode (–, at the bottom) (step III).

Figure 4A:
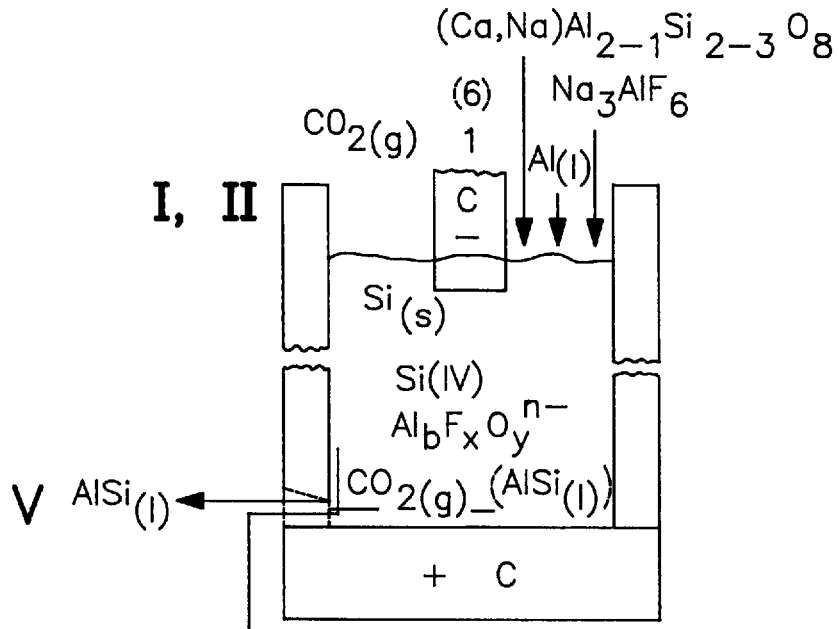
Figure 4B:
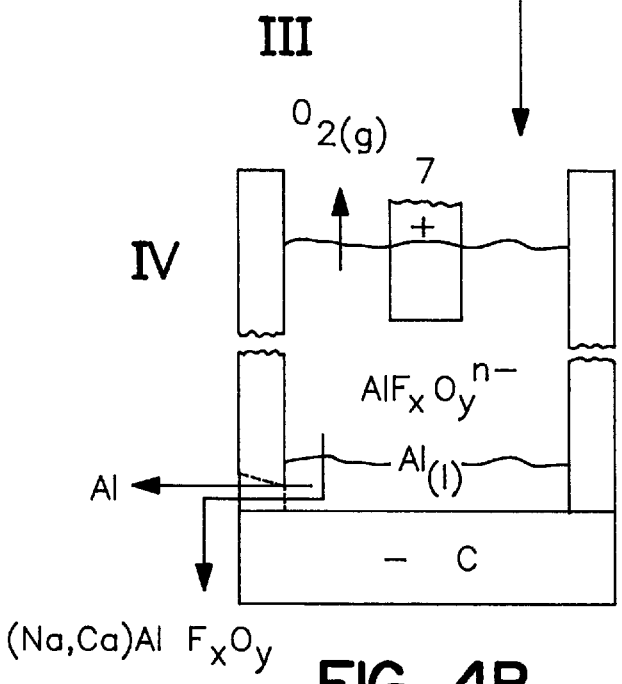

In FIGS. 4*a* and 4*b* the production of Si, AlSi and Al takes place in two furnaces connected above one another. Steps I and II take place in the first furnace (FIG. 4*a*) and step III in the second furnace (FIG. 4*b*).

In FIG. 5 the production of AlSi and Al takes place in two steps in one furnace, but in coupled series.

In FIG. 1 and FIG. 5, the production of Si takes place in a first furnace (step) and of AlSi and Al in two steps in one furnace coupled in series (steps and III respectively).

The furnaces (FIG. 1 and FIG. 5) can be connected in series. Silicon is produced in step I and aluminium in step III.

Figure 6:
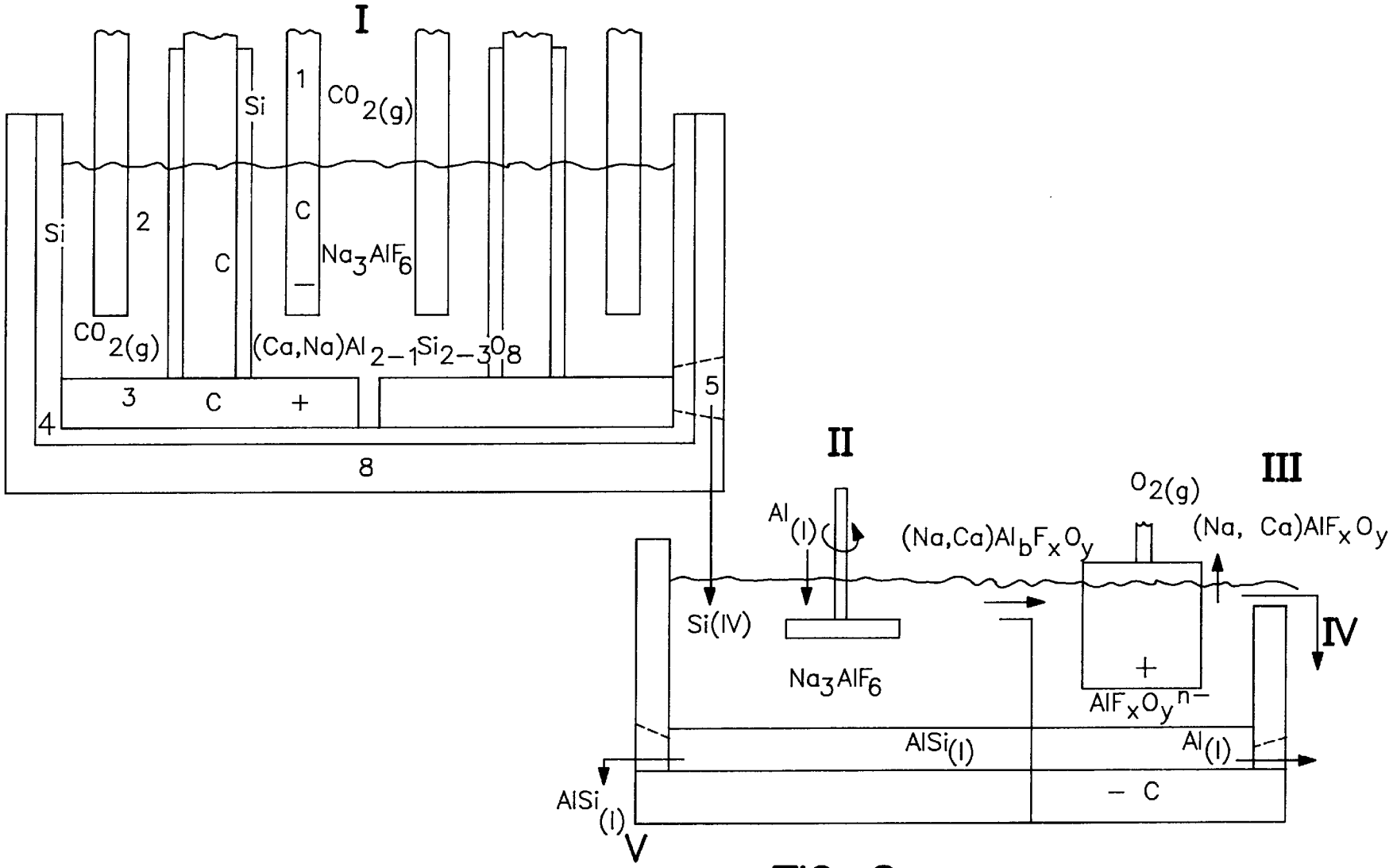
Figure 7:
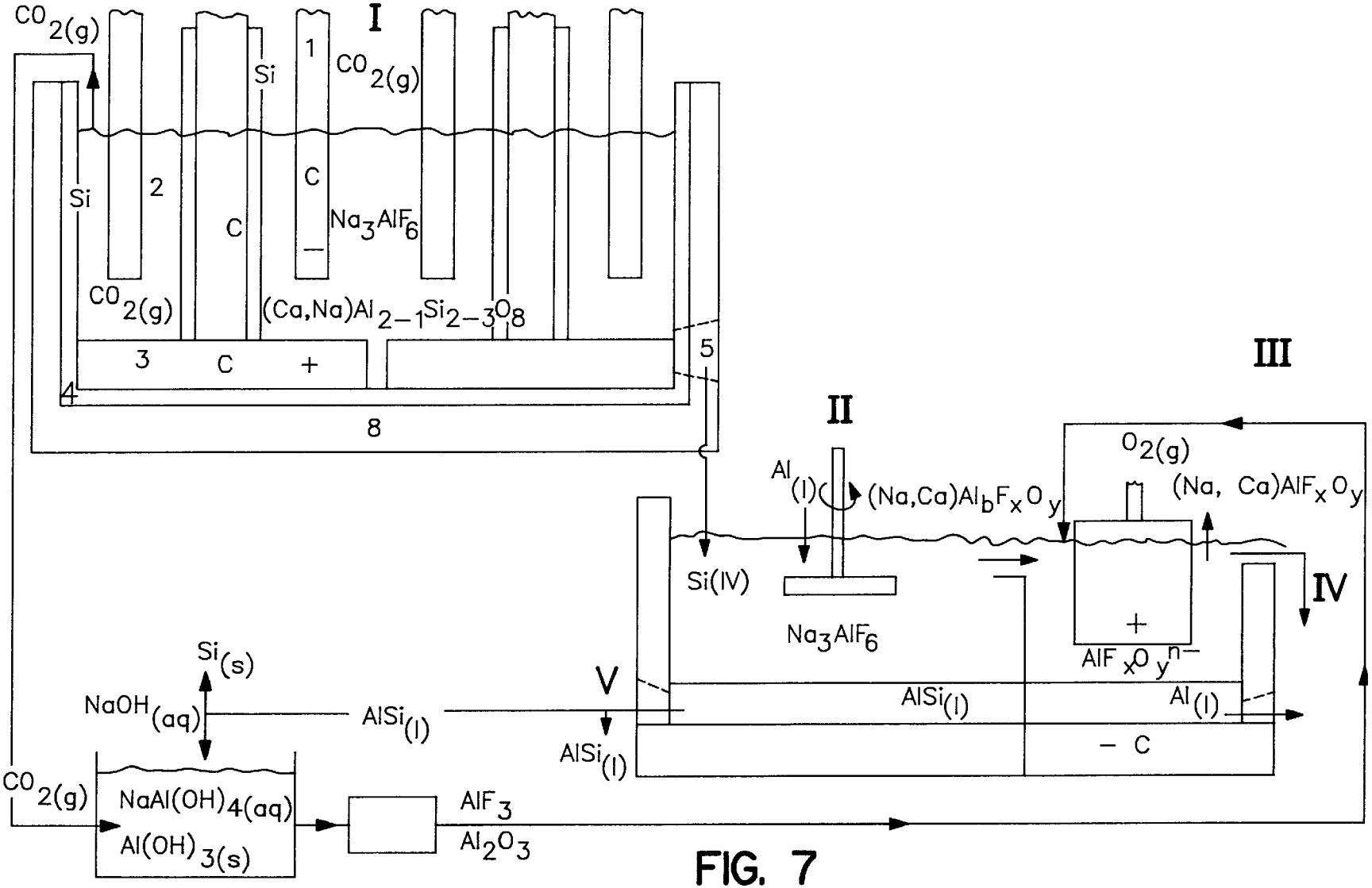

In step IV, the fluorides are recirculated and the usable chemicals from the residual electrolyte after Al production are produced (FIG. 3, FIG. 4*b* and FIG. 5). In step V (FIG. 2, FIG. 4*a*, FIG. 5 and FIG. 6), the Si is refined from AlSi by adding either sodium hydroxide or sulphuric acid, as shown in FIG. 6. Useful process chemicals are formed in step V and can be used in step III.

In FIG. 1, silicon is produced by electrolysis of an electrolyte containing feldspar; the feldspar is dissolved in a solvent containing fluoride, such as cryolite ($Na_3AlF_3$), sodium fluoride (NaF) or aluminium fluoride ($AlF_3$). The electrolyte containing feldspar means the use of all types of enriched feldspar within the compound $(Ca, Na)Al_{2-1}Si_{2-3}O_8$, "waste" feldspar within the same compound and species of rock containing feldspar. In FIG. 1, a cathode (1), for example of carbon, is connected at the top of a bath so that Si metal is precipitated as solid Si (2) at the cathode. Because Si(s) has a density of 2.3 and is heavier than the electrolyte with a density of approximately 2.1 (K-feldspar dissolved in cryolite), the Si particles will sink. Carbon dioxide ($CO_2$(g)), which is generated at the bottom evenly over a replaceable carbon anode (3), rises up through the electrolyte and takes with it the sinking Si particles up to the surface (flotation). The Si (s) which does not become attached to the cathode can then be removed from the surface of the bath. Enrichment of Si at the top of the bath takes place more completely if $BaF_2$ is added. $BaF_2$ is added to increase the density in the bath. The refining effect with $CO_2$ gas at 1000° C. makes possible a purity of Si which is close to "solar cell" quality. Production of "solar cell"-pure Si is important today now that oil supplies are being exhausted. Moreover, the furnace must consist of an electrical insulator (4) which prevents the generation of $CO_2$ from the side walls and which must, at the same time, be as resistant as possible to corrosion from the electrolyte containing Si(IV) and fluoride, and Al and Si "metal". The insulator must also not contaminate the Si which is produced. Preferably an insulation material containing Si or an insulator (4) of pure Si should be used as the smelt is very rich in Si(IV) (and rich in "alkalis"). Furthermore, FIG. 1 consists of an outer insulator which prevents the wall of the vessel (internal), consisting of silicon, from oxidising. The feldspar/cryolite smelt is contained in a rectangular vessel (walls) consisting of Si, with, preferably, rectangular carbon anodes lying on the bottom. The bottom of the bath can be covered by one or more carbon anodes. A carbon rod is fastened to each anode plate. The carbon rod is covered with a sleeve of Si to prevent the direct horizontal passage of current over to the vertically located carbon cathode(s). The tapping hole (5) is located at the bottom.

In order to remove Si from the bath, either enriched Si, which is in the form of small particles dispersed in the electrolyte, must be sucked out from the top of the bath, or the Si which has become attached to the cathode must be removed from the cathode. In both cases, the Si which is removed is cooled with inert gas ($CO_2$, $N_2$ or Ar) to below 600° C.

If the Si is to be stripped from the cathode, this must be done by removing the cathode from the bath and cooling it to the desired temperature. The cathode can either be stripped mechanically or lowered into water/$H_2SO_4$/HCl mixtures in all possible conceivable concentration compositions.

In both of the two above-mentioned cases, the Si is removed from the top of the electrolyte or from the cathode which is taken out and stripped. Instead of removing the Si from the top of the bath, Si which is floating in the bath could be precipitated. Si is heavier than the electrolyte if small amounts of feldspar are added to the cryolite or no $BaF_2$ is added. The cathode is stripped for Si while it is in the bath. It is only possible to have Si precipitated if the electrolysis is stopped for a short time after the required quantity of Si has been electrolysed. When Si has precipitated, it can then either be sucked up from the bottom (liquid electrolyte enriched with solid Si particles) or it can be tapped from the bottom ahead of the part of the electrolyte poor in Si which is in the upper layer. The advantage of still connecting the cathode at the top is that $CO_2$ is blown through the bath. With high current densities, turbulence will arise in the bath and the Si particles which are floating about come into good contact with the $CO_2$. This entails that Si formed is refined. Another advantage is that the Si particles which are lying at the bottom will not be bound to the bottom anode which would be the case if the bottom was connected cathodically. By the cathode, the Si particles would be bound in a layer near the cathode. Tests show that this layer is built up and becomes thicker as the electrolysis proceeds, regardless of whether the cathode is located at the top or the bottom. This layer consists mainly of Si particles and an electrolyte which is poor in Si(IV).

The Si which is dispersed in the electrolyte, and which is removed from the bath, is cooled down and crushed. The particles are separated using liquids, for example, $C_2H_2Br_4$/acetone mixtures with the desired density. The density of $C_2H_2Br_4$ is 2.96 g/cm . The Si particles are lighter (d=2.3 g/cm ) than the selected composition of the liquid mixture and will rise to the surface of the liquid while the electrolyte (d=3 g/cm ) will sink to the bottom. The electrolyte is not soluble in a $CHBr_3$/acetone mixture and the mixture can, therefore, easily be used again.

The Si particles from the top of the $C_2H_2Br_4$/acetone liquid are filtered from the liquid, dried and water/$H_2SO_4$/HCl mixtures are added in all possible conceivable concentrations before further refinement of the Si particles takes place.

Adding water/$H_2SO_4$/HCl causes further refinement of the Si beyond 99.7% to take place. Small quantities of particles of $Si_3Fe$ and SiAlNa alloys which are present will thus have their contaminations of Fe, Na, Al and other trace elements removed and a refined, "pure" Si is obtained.

In FIG. 1, step I, all or most of Si can be extracted during electrolysis. The Si which is not precipitated can be removed if Al scrap or aluminium of metallurgical grade type (Al (MG)) is added, FIG. 2, step II, before the Al electrolysis takes place, FIG. 3, step III. The addition of Al scrap or Al(MG) (FIG. 2, FIG. 4*a* and FIG. 5) while stirring with pipes (6) causes two advantages for the process shown in FIGS. 1–7. Firstly, the Si particles which have not been removed from the bath can be removed by being alloyed to the added Al. Secondly, the residues of the non-reduced Si(IV) in the bath will be reduced by the added Al. In both cases, the Si will be effectively removed and the AlSi formed, which proves to be heavier than the Al-rich salt smelt, forms its own phase and can be tapped from the bottom.

When the Si is removed from the bath as AlSi, the Al(III)-rich electrolyte can be electrolysed to produce Al metal (FIG. 3, FIG. 4*b* and FIG. 5, step III) with the added Al lying at the bottom so that the cathode is of Al and not of graphite In FIG. 3, FIG. 4*b* and FIG. 5, the cathode at the top of the bath now becomes the anode just by reversing the current (change of polarity). If the anode should produce oxygen, the carbon anode is replaced with an inert anode (7).

If Si is to be refined from the AlSi alloy (FIG. 7, step V), the quantities of $CO_2$ can be reduced by producing soda ($Na_2CO_3$) and/or $NaHCO_3$ if sodium hydroxide (NaOH) is used to dissolve AlSi. Reducing the use of $CO_2$ helps to reduce emissions (greenhouse effect). By using a weak concentration of NaOH when extracting Al from AlSi (step V), $Al_2O_3$ and $AlF_3$ are produced and the Si metal is refined. The $Al_2O_3$ and $AlF_3$ produced from this step can be added in step III if required. Sulphuric acid ($H_2SO_4$) can also be used to refine Si from AlSi produced (step V).

When Al metal is produced from step III (FIG. 3, FIG. 4*b* and FIG. 5), the Al-poor fluorooxo-rich residual electrolyte (step IV) must be used. Fluoride (F-) in mixtures with oxides must be recovered and recirculated and the oxides of Na, K and Ca ("alkalis") used. By adding $H_2SO_4$ to the residual electrolyte, hydrofluoric acid (HF) will be formed and cryolite, NaF and $AlF_3$ can be recovered from this. The oxides are converted into sulphates ($SO_4$2-) and hydrogen sulphate ($HSO_4$-) can be formed from Na-sulphate and/or K-sulphate as an intermediate product for the recovery of $H_2SO_4$.

In FIG. 1 and FIG. 4*a*, Si is produced separately by electrolysis (step I) before Al is added. In this way, Si can be produced as long as electrolysis takes place. It is desirable to produce as much Si as possible as it has a high degree of purity (over 99.8% Si). It is the electrolysis and the through-flow of the anode gas ($CO_2$) which cause the high purity of Si. As the $CO_2$ flows upwards, the Si particles which have been detached in the liquid electrolyte will be transported to the surface (flotation) even though the Si particles are heavier (d=2.3 g/cm )than the electrolyte (d=2.1 g/cm ). The fact that the Si particles are heavier than the electrolyte is an advantage because the particles will remain longer in the bath and thus achieve better contact with the $CO_2$ gas, which leads to a greater degree of refinement. The $CO_2$ gas through-flow upwards in the bath also prevents any sludge from being deposited so that the passage of the current (ion transport) is made easier. It is an advantage to locate a carbon cathode at the top of the bath instead of at the bottom. It is difficult to produce large quantities of Si with a carbon cathode at the bottom because Si is a solid material and must be removed gradually. If it is not removed, the resistance and the voltage will be uneconomically high as the Si will be deposited in a continually thicker layer at the bottom.

In order for the through-flow of the $CO_2$ gas through the electrolyte to be as even (laminar) as possible, an insulator wall consisting of silicon "metal" is mounted. The $CO_2$ gas will then be generated evenly from the anode surface (the bottom) and distributed as well as possible up through the electrolyte. If an insulator had not been used, the current would also have been passed through the wall in the bath in addition to the bottom and $CO_2$ gas would also have been generated on the wall. This would have caused Si particles to have poor contact with the $CO_2$ and the electrolyte and there would have been an uneven (turbulent) flow in the bath. Most materials corrode in cryolite. Since Si "metal" is formed in the bath, it is natural to use cast Si in the bath wall. As stated in the above, with reference to FIG. 1 and FIG. 4*a*, Si is produced separately by electrolysis (step I) before Al is added. One of the major advantages of step I is that it is possible to choose to regulate the quantity of Si which is required for extraction in relation to the silumin or Al. If, for example, all or a lot of Si is electrolysed and removed, no or very little silumin will be formed and it will be possible to use all or most of the aluminium (Al(III)) in the feldspar for the production of Al metal. Three examples are shown below.

Example 1

If a feldspar with composition $CaAl_2Si_2O_8$ is chosen, the mole ratio Si/Al=1. If the electrolysis goes on for so long that all Si is electrolysed and removed, step II will be superfluous. When the last residues of Si are precipitated, other metals such as Al and Na will be formed, which causes contaminated Si. If all Si were electrolysed and removed, an equally large mole quantity of Al would be produced from feldspar by electrolysis (step III).

Example 2

If the same feldspar ($CaAl_2Si_2O_8$) is chosen and electrolysed until 50% of Si has been electrolysed and removed, the rest (50%) of the Si must be removed with aluminothermic reduction. At approximately 1000° C., it is possible to form an AlSi alloy with a maximum of 50% Si (AlSi5O). This requires the consumption of 50% Al and only a net amount of 50% Al can, therefore, be produced by electrolysis (step III).

Example 3

If feldspar with the composition $NaAlSi_3O_8$, were electrolysed until 67% Si or less had been electrolysed and removed, all Al in the Na-feldspar must be used to remove the rest (33% Si) with aluminothermic reduction as the Si/Al mole ratio=3. This would mean that all Al in the Na-feldspar would be consumed and no net Al would remain. Therefore, there would be no net Al(III) which could be electrolysed.

The present invention also concerns the production of silicon, possibly silumin and/or aluminium by using process equipment comprising the integration of two or more furnaces to one unit with (an) intermediate partition wall(s) which is/are designed to transfer the electrolyte from one furnace to another. The electrolyte can be transferred by means of a difference in level between the height of the partition wall and the surface of the electrolyte or by pumping if the partition wall reaches right to the top.

I claim:

1. A process for continuous or batch production in one or more steps in one or more furnaces of silicon metal (Si), in a melting bath, using feldspar or feldspar containing rocks dissolved in a fluoride, characterised in that highly pure silicon metal is produced by electrolysis in a first step (step I) in a bath with a carbon cathode (1) placed at the top of the bath and a carbon anode (3) placed at the bottom of the bath, $CO_2$ gas is generated at the anode (3) during electrolysis and flows upwards through the bath and being brought into contact with silicon which is formed at the cathode (1) which contributes to removing contamination from the Si particles produced which are attached to the cathode, and, at the same time, moves the detached Si particles to the surface of the bath to extract Si metal; that silumin is produced in a second step (step II) by adding Al metal to the residual electrolyte from the bath so that the remaining Si and Si(IV) are reduced and precipitated as silumin; and that aluminium metal is produced in a second or third step (step III) by electrolysis after Si has been removed in step I or after residual Si and Si(IV) are removed in step II.

2. A process in accordance with claim 1, characterised in that the silicon metal produced in step I is extracted by Si enriched at the top of the bath being taken out, the cathode being removed from the bath and Si which is attached to it being removed, and Si in the bath and on the cathode being precipitated to the bottom by stopping the electrolysis, after which it is removed from the bottom.

3. A process in accordance with claim 1, characterised in that Si-free residual electrolyte from step I is electrolysed directly to produce aluminium metal (step III).

4. A process in accordance with claim 1, characterised in that step II comprises addition of aluminium or aluminium scrap in a quantity such that silumin is produced with a preselected ratio between Si and Al from step I and an Al-rich, Si-poor electrolyte.

5. A process in accordance with claim 4, characterised in that Al bound in silumin is selectively dissolved by NaOH and solid Si is separated and that $CO_2$ gas is added to the resulting Al-rich solution, the $CO_2$-gas being at least partly formed at the anode in step I, so that $Al(OH)_3$ is precipitated and the precipitated $Al(OH)_3$ is converted by a known method to $Al_2O_3$ and/or $AlF_3$.

6. A process in accordance with claim 4, characterised in that the Al-rich, Si-poor electrolyte from step II is electrolysed in step III.

7. A process in accordance with claim 4, characterised in that the Al-rich, Si-poor electrolyte obtained from step II is electrolysed in step III after addition of $Al_2O_3$ and/or $AlF_3$.

8. A process in accordance with claim 1, characterised in that Al bound in silumin is selectively dissolved by NaOH and solid Si is separated and that $CO_2$ gas is added to the resulting Al-rich solution, the $CO_2$-gas being at least partly formed at the anode in step I, so that $Al(OH)_3$ is precipitated and the precipitated $Al(OH)_3$ is converted by a known method to $Al_2$ $O_3$ and/or $AlF_3$.

9. A process in accordance with claim 1, characterised in that the Al-rich, Si-poor electrolyte from step II is electrolysed in step III.

10. A process in accordance with claim 1, characterised in that the Al-rich, Si-poor electrolyte obtained from step II is electrolysed in step III after addition of $Al_2O_3$ and/or $AlF_3$.

11. Process equipment for continuous or batch production in one or more steps in one or more furnaces of silicon metal (Si), in a melting bath, using feldspar or feldspar containing rocks dissolved in a fluoride, characterised in that it comprises at least two furnaces, a first one for production of silicon metal (step I) comprising a container (8) where the walls (4) of the container are insulated by silicon, an anode (3) consisting of at least one piece of carbon arranged in the base of the container (8), a vertical piece of carbon is attached to the piece of carbon or pieces of. carbon which comprise the anode (3) and said vertical piece of carbon being surrounded by insulating material like silicon, and at least one cathode (1) of carbon which is arranged at the top of the container (8).

12. Process equipment in accordance with claim 11, characterised in that the second and third furnaces are integrated to form a unit with an intermediate partition wall so that the electrolyte from the second furnace is designed to be transferred to the third furnace for the production of aluminium metal in the latter (FIGS. 5*a–b*).

13. Process equipment in accordance with claim 11, characterised in that the first and third furnaces are integrated to form a unit with an intermediate partition wall, and the Si-free residual electrolyte from the first furnace is designed to be transferred to the third furnace for the production of aluminium metal in the latter.

14. Process equipment in accordance with claim 11, characterised in that the, furnaces are integrated to form a unit with intermediate partition walls.

15. Process equipment in accordance with claims 11, characterised in that the anode or anodes (3) is/are replaceable as the vertical piece of carbon which is fastened to the piece of carbon (anode) at the bottom of the container is/are designed in such a way that it/they can be removed from the container in order that a new piece of carbon can be fitted.

* * * * *